US010737870B2

(12) United States Patent
Song

(10) Patent No.: US 10,737,870 B2
(45) Date of Patent: Aug. 11, 2020

(54) CONTAINER FOR DISCHARGING LIQUID

(71) Applicant: Seon Hye Song, Gyeonggi-do (KR)

(72) Inventor: Seon Hye Song, Gyeonggi-do (KR)

(73) Assignee: Seon Hye Song, Gyeonggi-do (KR)

( * ) Notice: Subject to any disclaimer, the term of this patent is extended or adjusted under 35 U.S.C. 154(b) by 89 days.

(21) Appl. No.: 15/817,636

(22) Filed: Nov. 20, 2017

(65) Prior Publication Data

US 2019/0152680 A1 May 23, 2019

(51) Int. Cl.

| | |
|---|---|
| ***B65D 83/00*** | (2006.01) |
| ***A45D 34/00*** | (2006.01) |
| ***B05B 11/02*** | (2006.01) |
| *B65D 47/12* | (2006.01) |

(52) U.S. Cl.

CPC ..... *B65D 83/0033* (2013.01); *A45D 34/00* (2013.01); *B05B 11/02* (2013.01); *A45D 2200/055* (2013.01); *B65D 47/122* (2013.01)

(58) Field of Classification Search

CPC ..... B05B 11/02; B05B 11/04; B65D 83/0033
USPC ..... 401/263, 265
See application file for complete search history.

(56) References Cited

U.S. PATENT DOCUMENTS 2,898,007 A * 8/1959 Gassaway ..... B65D 83/0033 222/212
3,165,242 A * 1/1965 Jackson ..... B65D 35/46 222/495
3,456,650 A * 7/1969 Schwartzman .... B65D 47/2075 604/298
2005/0184101 A1* 8/2005 Masuda ..... B65D 47/2075 222/380
2015/0175314 A1* 6/2015 Kim ..... B65D 47/2075 222/92

FOREIGN PATENT DOCUMENTS

| | | |
|---|---|---|
| DE | 3202275 A1 | 8/1983 |
| DE | 202015104599 U1 | 11/2015 |
| JP | S6344452 | 3/1988 |
| KR | 20-0472459 | 4/2014 |
| WO | 2011138997 A1 | 11/2011 |

OTHER PUBLICATIONS

Machine Translation of DE202015104599. Retrieved from Espacenet. (Year: 2019).*

* cited by examiner

*Primary Examiner* — Erin Deery
(74) *Attorney, Agent, or Firm* — Berenato & White, LLC

(57) ABSTRACT

A liquid discharge container includes a container body having a space in which liquid contents are accommodated, a discharge port through which the contents are discharged, and a push plate for supporting the contents and pushing up the contents. An intermediate joint formed of an intermediate plate member is coupled to a lower side of the container body. A one-way check valve is formed at the center of the intermediate plate member, and a lower fastening member is formed at a lower portion of the intermediate plate member. A cylindrical bottom support is coupled to the lower fastening member of the intermediate joint. A shape resilient body is coupled to a lower portion of the intermediate joint, and is compressible and recoverable with a vent hole at the lower center of the shape resilient body, and that comes in contact with the bottom support.

5 Claims, 12 Drawing Sheets

CONTAINER FOR DISCHARGING LIQUID

FIELD OF THE INVENTION

The present invention relates to a liquid discharge container such as a liquid dispenser, and more particularly, to a liquid discharge container capable of discharging a proper amount of a liquid-phase material used in cosmetics or the like when a user desires.

BACKGROUND OF THE INVENTION

Generally, discharge containers are widely used for discharging liquid contents of cleaning products such as shampoo, rinse, etc., cosmetics and the like. An example of a dispensing device used in such a cosmetics discharge container is shown in FIG. 1. The dispensing device for a cosmetics container shown in FIG. 1 (Korean Utility-model Application Publication No. 20-472459 published on Apr. 29, 2014) is coupled to an upper part of the cosmetics container in which liquid cosmetics are contained and discharges a certain amount of cosmetics, and is provided with a button 10 provided on an upper side of the dispensing device and a nozzle 11 coupled to a front surface of the button 10. A shaft 20 extending vertically is coupled to a lower side of the button 10, and the shaft 20 is supported by a spring 21. The button 10 is pressed downward and inserted into a cover 30 coupled to an opening of the cosmetic container. A fixed cap 40 is coupled to the inside of the cover 30. The lower end of the shaft 20 is inserted into the upper side of the fixed cap 40 and a stem 50 coupled with the piston 60 is inserted into the lower side of the fixed cap 40, and is inserted into the inner side of the shaft 20. A transfer space 51 is formed in the inside of the stem 50. An upper side of the transfer space 51 is opened and contents are transferred through the transfer space 51. A plurality of throughholes 52 communicating with the transfer space 51 are formed radially on the lower outer circumferential surface of the stem 50. Meanwhile, a housing 80 is provided in the lower side of the fixed cap 40 and a fixing ring 31 coupled to an outer circumferential surface of the housing 80 is fixed to the inner side of the cover 30. The shaft 20, the stem 50, and the piston 60 are configured to move up and down in the inner side of the housing 80. In addition, the inside of the housing 80 is provided with an opening and closing member 70 which can move up and down. A space 71 opened upward is formed inside the opening and closing member 70. A hemispherical head 72 is formed on the lower side of the opening and closing member 70 and a plurality of wings 73 are formed radially on the outer circumferential surface of the opening and closing member 70. An air hole 81 is formed on the upper outer circumferential surface of the housing 80. A step 82 is formed on the inner lower end of the housing 80 and a suction hole 83 is formed on the lower side of the step 82. The wings 73 of the opening and closing member 70 serve as a stopper which is brought into close contact with the step 82 so that the wings 73 can no longer move upward. The suction hole 83 is opened or closed since the head 72 is spaced apart from or comes into close contact with the suction hole 83. A contact portion 84 is formed on the inner circumferential surface of the upper end portion of the suction hole 83 so as to be in close contact with the head 72. The contact portion 84 is formed in a circular arc shape corresponding to the hemispherical head 72. When the button 10 is pressed downward in order to discharge the contents in the cosmetic container dispenser configured as described above, the stem 50 and the piston 60 descend together and the outside air is sucked toward the inside of the housing 80 through the air hole 81. While the contents filled between the stem 50 and the opening and closing member 70 are compressed, the opening and closing member 70 is lowered and the head 72 seals the suction hole 83. Here, as the stem 50 descends, a pressure is generated inside the housing 80 so that the piston 60 rises up. As a result, the contents are sucked into the transfer space 51 through the opened throughholes 52, and discharged through the nozzle 11.

However, such a conventional cosmetics discharge device has a disadvantage in that the manufacturing cost is increased due to a large number of components and a complicated structure, and thus the cost of the finished product filled with the contents of the cosmetics is considerably high. In addition, the cosmetic liquid which is filled in the lower part of the container is sucked up and discharged. However, the contents located on the bottom of the container below an infusion tube for sucking the contents remain, and the contents are not completely exhausted.

SUMMARY OF THE INVENTION

Accordingly, the present invention has been made keeping in mind the above problems occurring in the prior art, and it is an object of the present invention to provide a liquid discharge container having a dispenser structure for discharging a liquid material easily, to thereby completely exhaust the contents while providing easy operations, and reduce manufacturing cost with fewer parts.

A liquid discharge container according to an embodiment of the present invention includes: a container body having a space in which liquid contents are accommodated, a discharge port through which the contents are discharged and formed at the center of an upper plate, and a push plate for supporting the contents and pushing up the contents and discharging the contents through the discharge port is coupled;

an intermediate joint formed of an intermediate plate member coupled to a lower side of the container body, a one-way check valve formed at the center of the intermediate plate member to allow upward movement of the air and prevent downward movement of the air, and a lower fastening member formed at a lower portion of the intermediate plate member;

a cylindrical bottom support which is coupled to the lower fastening member of the intermediate joint so as to be elevated and lowered; and a shape resilient body that is coupled to a lower portion of the intermediate joint, and is formed to be compressible and recoverable with a vent hole at the lower center of the shape resilient body, and that comes in contact with an inner bottom surface of the bottom support, by the descent of the intermediate joint, thereby closing the vent hole and compressing the air in the shape resilient body, to thus make the air move up through the check valve, wherein, when the contents are to be discharged, the container body is pressed down to lower the intermediate joint together with the container body, and the shape resilient body coupled to the intermediate joint is lowered, to thus come into contact with the bottom of the bottom support and simultaneously the shape resilient body is compressed while the vent hole of the shape resilient body is closed by the bottom of the bottom support, so that the internal air of the shape resilient body is supplied to the lower portion of the container body through the check valve of the intermediate joint and the contents are discharged while the push plate is lifted up.

In addition, a coupling member is formed in a lower portion of the container body, and an upper fastening member formed in a circumferential direction of the upper portion of the intermediate plate member is formed in the intermediate joint in order to engage with the coupling member of the container body, and the coupling member of the container body and the upper fastening member of the intermediate joint are formed of respective thread portion to be screwed with each other, and vertical grooves are formed in the threads of the respective thread portions so that the contents are not discharged through the discharge port when the intermediate joint and the container body are engaged with each other.

In addition, a concave groove is formed in the circumferential direction of the lower end of the coupling member of the container body, and a protrusion corresponding to the concave groove is formed in a circumferential direction of the intermediate joint so as to be sealingly coupled to the concave groove when the engagement of the coupling member of the container body and the upper fastening member of the intermediate joint is completed.

In addition, a longitudinal guide groove is formed in the lower fastening member of the intermediate joint and a fitting protrusion coupled to the guide groove of the intermediate joint is formed in the bottom support to guide the vertical movement of the bottom support.

In addition, the lower fastening member of the intermediate joint is formed with a moving groove extending in the circumferential direction from the guide groove and moving the fitting protrusion of the bottom support, and a coupling jaw is formed on the upper side of the moving groove in the lower fastening member so that the fitting protrusion of the bottom support is seceded from the guide groove and positioned in the moving groove to thus prevent the fitting protrusion from vertically moving by the coupling jaw formed on the upper side of the moving groove.

In addition, the moving groove is provided with stopping jaws at one end of the moving groove adjacent to the guide groove and at the other end of the moving groove positioned on the opposite side of the guide groove, and a fixing groove for fixing the fitting protrusion is formed on the outer side of the opposite stopping jaw.

In addition, a discharge port insertion member is coupled to the discharge port of the upper plate and the discharge port insertion member includes: an intermediate insertion portion having a smaller diameter than the discharge port and inserted into the discharge port; a seating portion formed on the upper portion of the intermediate insertion portion and seated on the upper plate; and a wedge-shaped wedge portion formed at the lower portion of the intermediate insertion portion so that the discharge port insertion member is not drawn upward from the discharge port.

In addition, an upper cap is provided in the upper portion of the container body so as to be opened and closed with respect to the container body, and a circular pressing leg portion for pressing the seating portion of the discharge port insertion member and closing the discharge port is formed to extend downwardly from the upper cap.

In addition, a support foot portion is coupled to the lower portion of the push plate to prevent the push plate from moving below the container body, the center of the support foot portion is coupled to the push plate by an engaging member, and the support foot portion is divided into a plurality of support feet extending radially from the center and the end portions of the plurality of support feet are in contact with the inner circumferential surface of the container body.

In addition, a cylindrical mounting portion is formed on the lower surface of the upper plate and a check valve located below the discharge port is coupled to the center of the bottom of the cylindrical mounting portion, to allow the contents to move upward and to prevent the contents from moving downward, so that the contents of the container body is discharged to the discharge port through the check valve.

In addition, a circular support wall for supporting the lower portion of the shape resilient body is formed on the inner bottom surface of the bottom support and a central protrusion for closing the vent hole of the shape resilient body is formed in the inner center of the circular support wall, wherein, when the contents are to be discharged, the container body is pressed down to lower the intermediate joint together with the container body, and the shape resilient body coupled to the intermediate joint is lowered, so that the shape resilient body is compressed while the vent hole of the shape resilient body is closed by the central protrusion provided on the bottom of the bottom support, and the internal air of the shape resilient body is supplied to the lower portion of the container body through the check valve of the intermediate joint and the contents are discharged while the push plate is lifted up.

In addition, the central protrusion has a conical closing protrusion and the conical closing protrusion of the central protrusion is inserted into the vent hole of the shape resilient body when the shape resilient body is lowered, and closes the vent hole.

In addition, a plurality of support legs for supporting the shape resilient body are formed on the lower portion of the shape resilient body, and when the intermediate joint is lowered together with the container body by pressing the container body, the shape resilient body coupled to the intermediate joint is lowered and the support leg is bent so that the vent hole of the shape resilient body is closed by the central protrusion.

According to another embodiment of the present invention, a liquid discharge container includes: a container body having a space in which liquid contents are accommodated, a discharge port through which the contents are discharged and formed at the center of an upper plate, and a push plate for supporting the contents and pushing up the contents and discharging the contents through the discharge port is coupled for supporting the contents and pushing the contents and discharging the contents through the discharge port, and coupled to the inside of the container body; an intermediate joint having an intermediate plate member coupled to a lower side of the container body and having a throughhole at a center of the intermediate plate member and a lower fastening member formed at a lower portion of the intermediate plate member; a shape resilient body that is coupled to a lower portion of the intermediate joint, and is formed to be compressible and recoverable with a vent hole at the lower center of the shape resilient body, and a circular support leg around the vent hole, thereby compressing the air in the shape resilient body by the descent of the intermediate joint, to thus make the internal air move upward; and a cylindrical bottom support coupled to the lower fastening member of the intermediate joint so as to be elevated and lowered, in which a circular coupling protrusion is formed on the bottom surface of the cylindrical bottom support so that the circular support leg is coupled to the inner side of the circular coupling protrusion and a check valve is formed on the inner bottom of the circular coupling protrusion to allow the inflow of air into the container body and prevent the air to flow out from the container body, wherein, when the contents are to be discharged, the container body is pressed down to lower the intermediate joint together with the container body, and the shape resilient body coupled to the intermediate joint is lowered, so that the shape resilient body is compressed and the internal air of the shape resilient body is supplied to the lower portion of the container body through the throughhole of the intermediate joint and the contents are discharged while the push plate is lifted up.

DETAILED DESCRIPTION OF THE PREFERRED EMBODIMENT(S)

Hereinafter, a liquid discharge container according to a preferred embodiment of the present invention will be described in detail with reference to the drawings.

Figure 1:
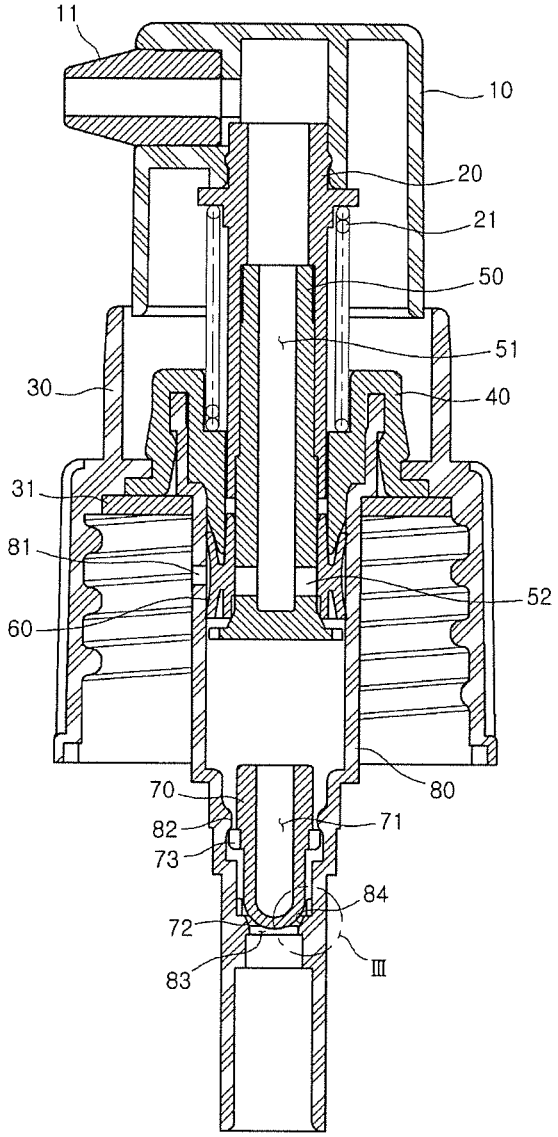
FIG.1 (PRIOR ART)
FIG. 1 is a cross-sectional view showing an example of a conventional cosmetic dispensing apparatus.
Figure 2:
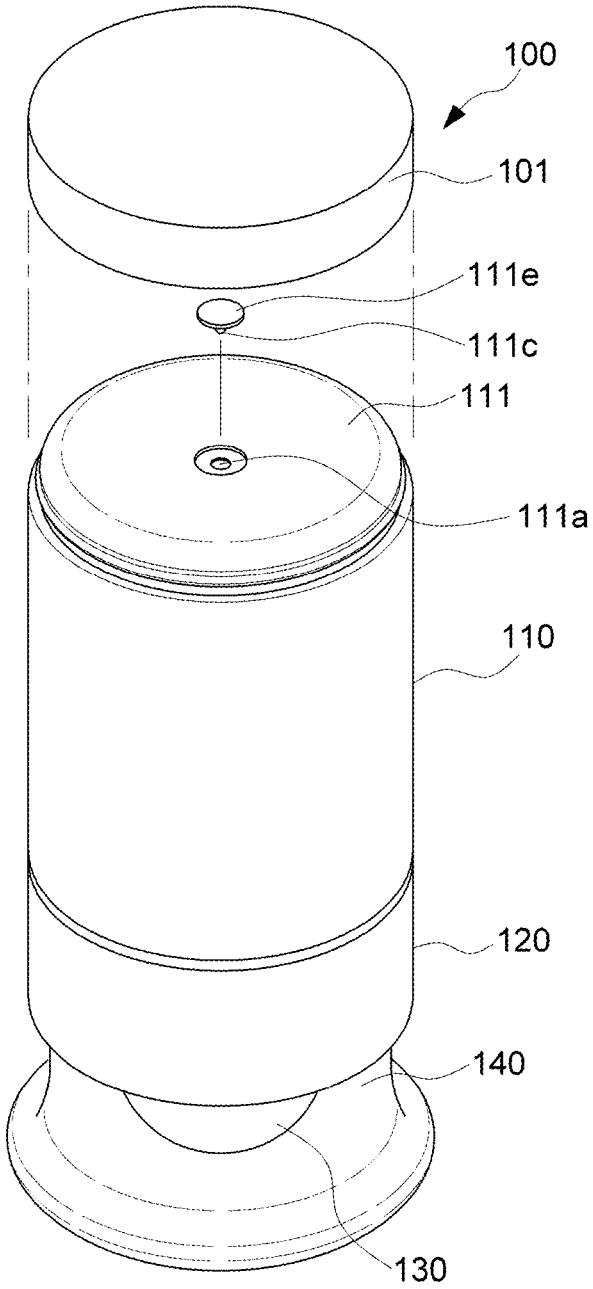
FIG. 2 is a perspective view of a liquid discharge container according to an embodiment of the present invention.
Figure 3:
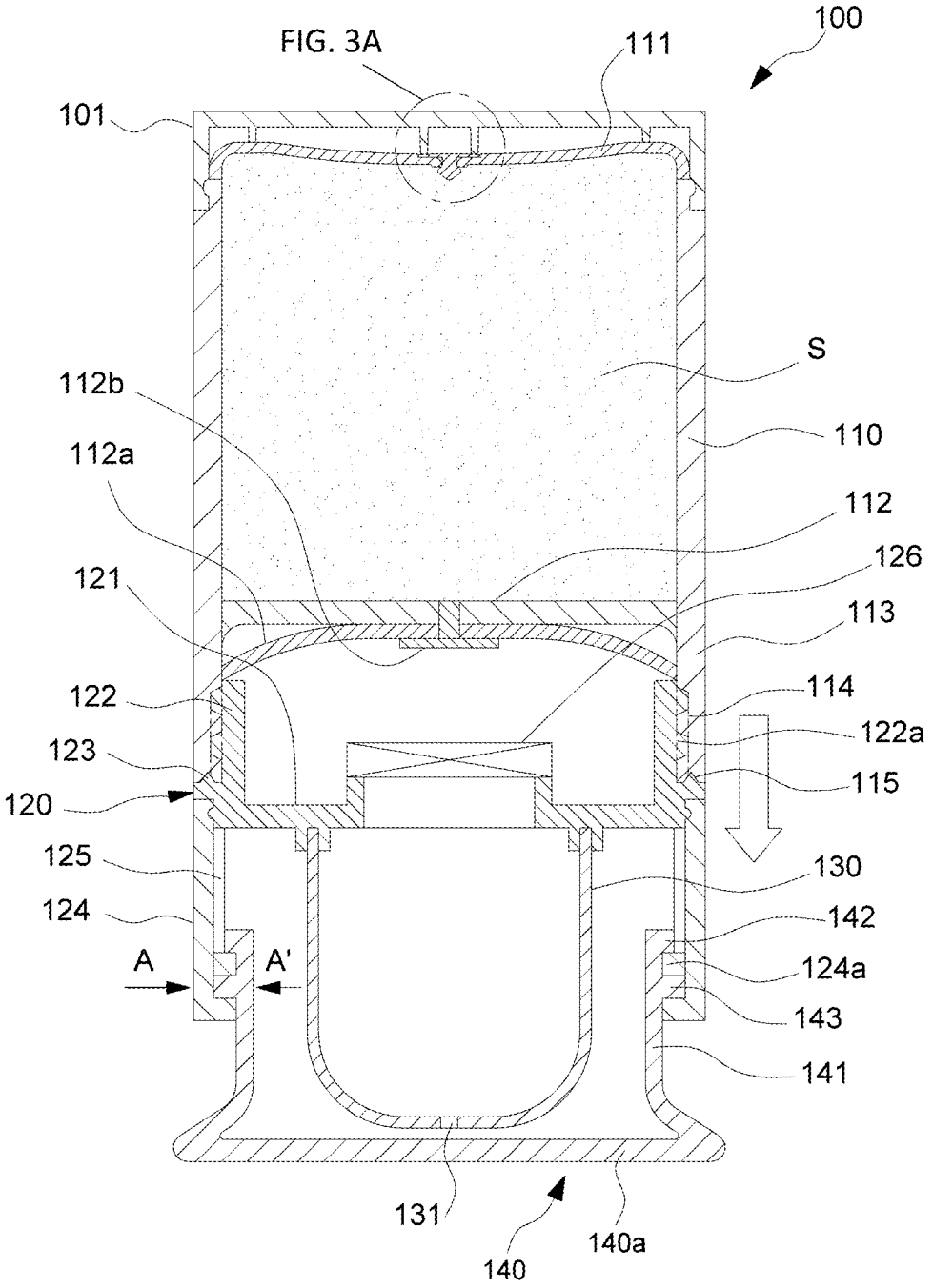
FIG. 3 is a cross-sectional view of a liquid discharge container according to a first embodiment of the present invention.
Figure 3A:
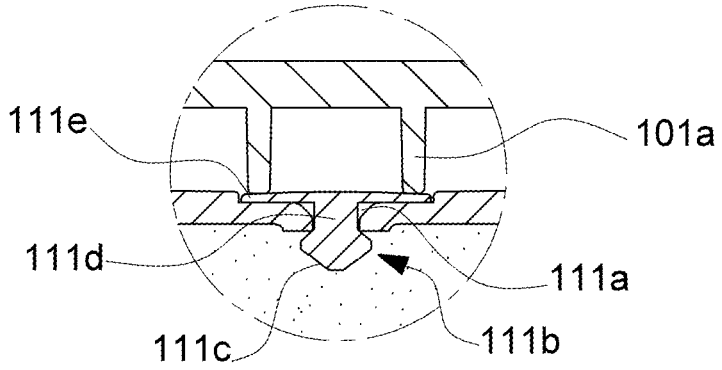
FIG. 3A is an enlarged cross-sectional view of the encircled portion of FIG. 3.
Figure 4:
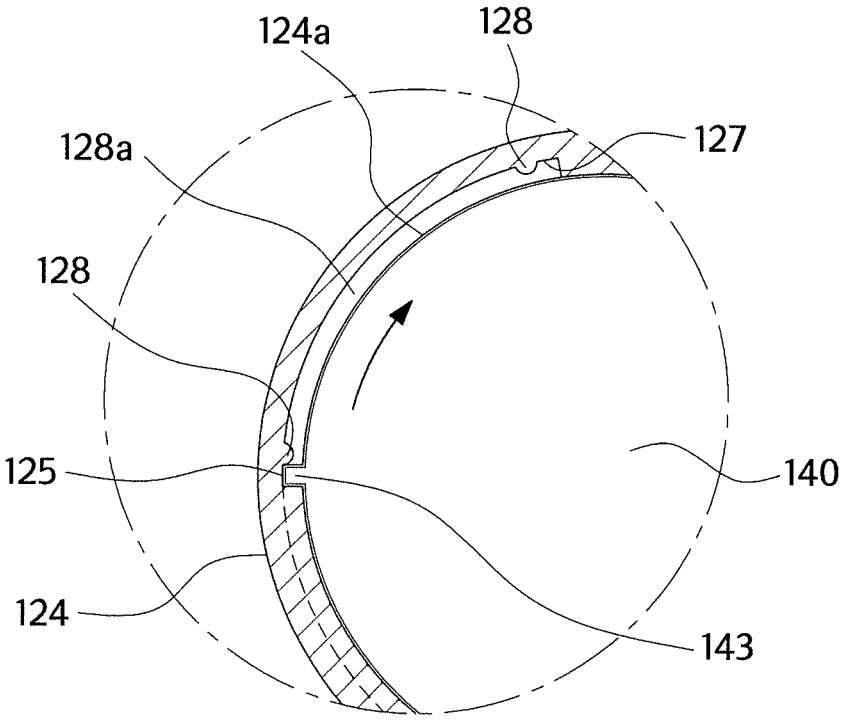
FIG. 4 is a cross-sectional view taken along the line A-A' in FIG. 3.
Figure 5:
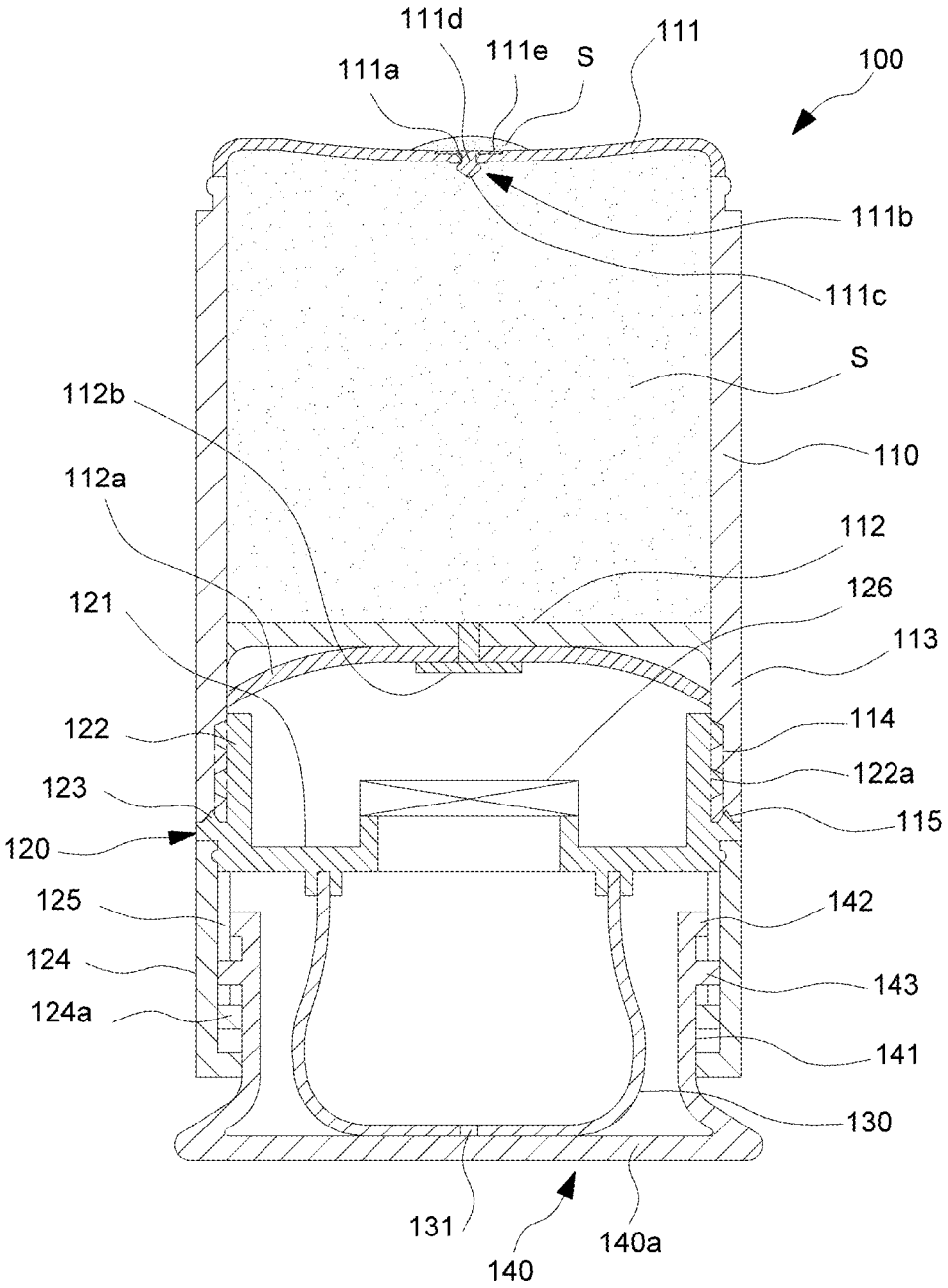
FIG. 5 is a cross-sectional view for explaining an operation of the liquid discharge container according to the first embodiment of the present invention.

FIG. 2 is a perspective view of a liquid discharge container according to an embodiment of the present invention. FIG. 3 is a cross-sectional view of a liquid discharge container according to a first embodiment of the present invention. FIG. 4 is a cross-sectional view taken along the line A-A' in FIG. 3. FIG. 5 is a cross-sectional view for explaining an operation of the liquid discharge container according to the first embodiment of the present invention.

First, the liquid discharge container 100 according to the first embodiment of the present invention includes: a container body 110 in which a liquid substance such as a cosmetic is received and formed on an upper portion of the liquid discharge container 100; an intermediate joint 120 coupled to the lower portion of the container body 110; a shape resilient body 130 coupled to the intermediate joint 120, so as to be compressible and recoverable; and a cylindrical bottom support 140 which is coupled to the lower portion of the intermediate joint 120 to move up and down.

The container body 110 has a cylindrical shape and is formed to have a space in which liquid contents S are accommodated. A discharge port 111*a* through which the contents S are discharged is formed at the center of an upper plate 111 coupled to an upper portion of the container body 110. In addition, a push plate 112 for supporting the contents S is coupled to the inside of the container body 110 and a coupling member 113 for coupling the intermediate joint 120 to the container body 110 is formed at a lower portion of the container body 110. The coupling member 113 is formed with a thread portion of a trapezoidal thread shape in the circumferential direction of the inner circumferential surface of the coupling member 113 and is screwed to the upper fastening member 122 of the intermediate joint 120, and is formed with vertical grooves 114 at intervals of 90 degrees along the circumferential direction of the coupling member 113 in the trapezoidal threads. The vertical grooves 114 are provided to allow the air to escape from the container body 110 when the intermediate joint 120 is fastened with the container body 110. In addition, a triangular concave groove 115 is formed in the circumferential direction at the lower end of the coupling member 113. When the coupling member 113 is completely screwed into the upper fastening member 122 of the intermediate joint 120, a protrusion 123 of the intermediate joint 120 to be described later is engaged with the concave groove 115 at the lower end of the coupling member 113.

A support foot portion 112*a* is coupled to the lower portion of the push plate 112. The support foot portion 112*a* is made of a metal material to prevent the push plate 112 supporting the contents S from moving downward in the container body 110. The support foot portion 112*a* is divided into a plurality of support feet extending radially at its center of the support foot portion 112*a* and the ends of the plurality of support feet are bent downward to come in contact with the inner circumferential surface of the container body 110. The center of the support foot portion 112*a* is engaged with the lower portion of the push plate 112 by the engaging member 112*b*.

When the container body 110 is pushed downward to discharge the contents S, the internal air of the shape resilient body 130 is moved upward while the shape resilient body 130 is compressed and the push plate 112 is lifted up. The liquid contents S are discharged through the discharge port 111*a* while the push plate 112 is lifted up together with the support foot portion 112*a*. When the pressing of the container body 110 is released, the push plate 112 may descend downward by the weight of the contents S, and the support foot portion 112*a* according to the embodiment of the present invention may come in contact with the inner circumferential surface of the container body 110, to thus support the push plate 112 and to prevent the push plate 112 from being lowered. Further, the contents S discharged through the discharge port 111*a* are not moved downward again through the discharge port 111*a*.

The upper plate 111 of the container body 110 may be integrally formed with the container body 110 or may be screwed to the container body 110. As shown in FIG. 3, a circular discharge port 111*a* through which the contents are discharged is formed at the center of the upper plate 111, and a discharge port insertion member 111*b* is coupled to the discharge port 111*a*. The discharge port insertion member 111*b* has an intermediate insertion portion 111*d* to be inserted into the discharge port 111*a*, a seating portion 111*e* to be seated on the upper plate 111, and a wedge-shaped wedge portion 111*c* to be formed in the lower portion of the intermediate insertion portion 111*d*, all of which are integrally formed.

The seating portion 111*e* of the discharge port insertion member 111*b* is formed on the upper portion of the intermediate insertion portion 111*d* and has a diameter larger than the diameter of the intermediate insertion portion 111*d*, to thus be seated on the upper plate 111.

The intermediate insertion portion 111*d* of the discharge port insertion member 111*b* is inserted into the discharge port 111*a* with a smaller diameter than the discharge port 111*a* and the contents S are discharge upward through the gap between the discharge port 111*a* and the intermediate insertion portion 111*d*.

The wedge portion 111*c* of the discharge port insertion member 111*b* is formed at the lower portion of the intermediate insertion portion 111*d* and is positioned below the discharge port 111*a*. The wedge portion 111*c* has a diameter larger than the diameter of the intermediate insertion portion 111*d* and the diameter of the discharge port 111*a* so that the discharge port insertion member 111*b* does not fall upward from the discharge port 111*a* when the contents are discharged through the discharge port 111*a*.

In some embodiments of the present invention, when the discharge port insertion member 111*b* is coupled to the discharge port 111*a* to discharge the contents S by pushing down the container body 110, the contents S are moved up through the gap between the discharge port 111*a* and the intermediate insertion portion 111*d*, and the discharge port insertion member 111*b* rises slightly up within the discharge port 111*a* and the seating portion 111*e* is separated from the upper plate 111 so that the contents S are discharged onto the upper plate 111. When the pressing of the container body 110 is released, the seating portion 111*e* is seated on the upper plate 111, and the discharged contents S are prevented from moving below the discharge port 111*a*.

An upper cap 101, which is openably and closably coupled to the container body 110, is provided on the upper part of the container body 110. The upper cap 101 is screwed to the container body 110 and a circular pressing leg portion 101*a* is integrally formed at a lower portion of the upper cap 101. The circular pressing leg portion 101*a* extends downward and presses the seating portion 111*e* of the discharge port insertion member 111*b*. Therefore, when the upper cap 101 is engaged, the pressing leg portion 101*a* of the upper cap 101 presses the seating portion 111*e* to close the discharge port 111*a*, so that the contents S are not discharged from the discharge port 111*a* even when external pressure changes.

Figure 11:
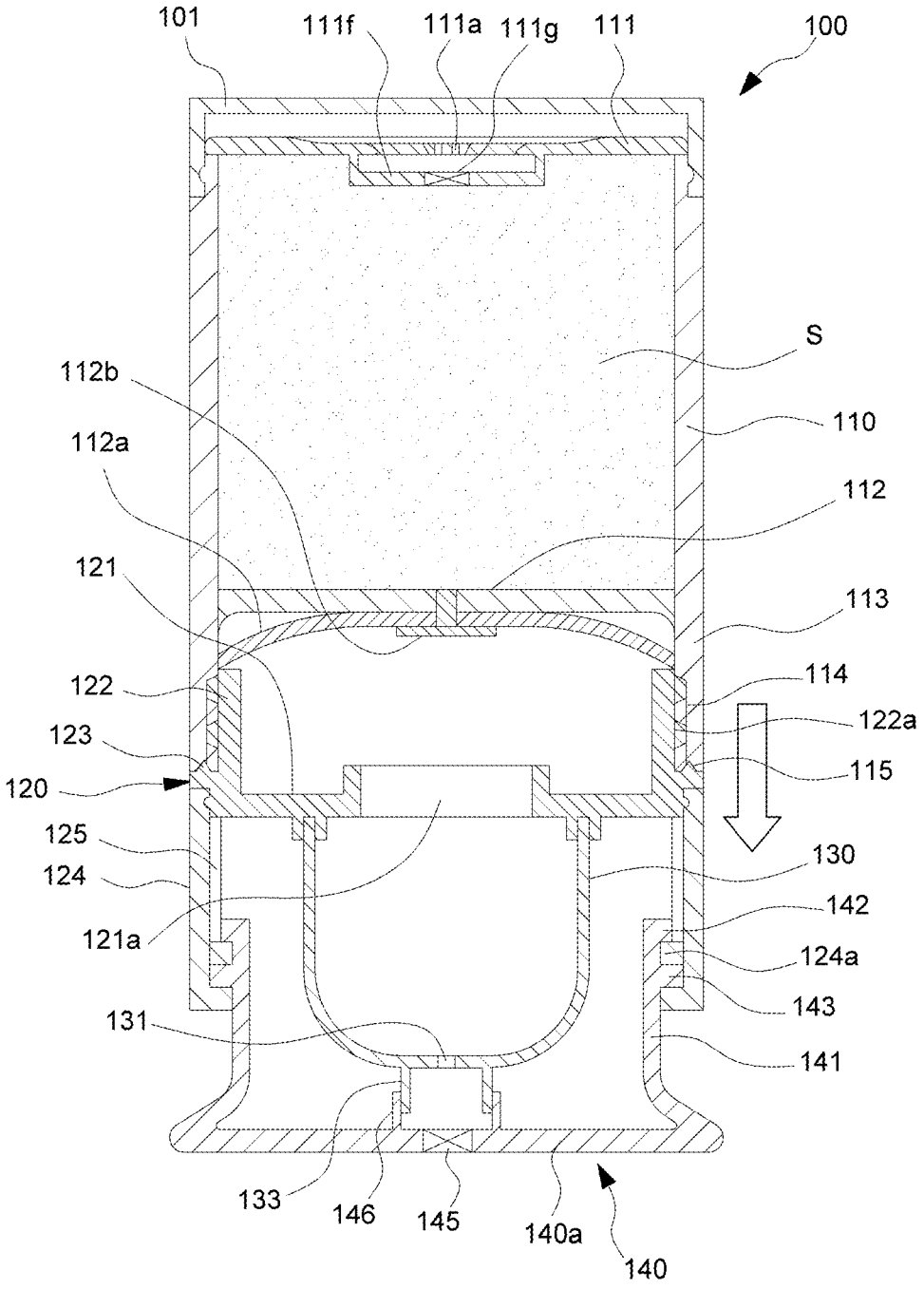
FIG. 11 is a cross-sectional view of a liquid discharge container according to a fifth embodiment of the present invention.

In addition, in the first embodiment, the upper plate 111 as shown in FIG. 3 may be configured to have a check valve 111*g* under the discharge port 111*a* as shown in FIG. 11 instead of the upper plate 111 inserted into the discharge port 111*a*. The configuration of the upper plate 111 shown in FIG. 11 will be described later.

The intermediate joint 120 is coupled to the lower portion of the container body 110 and includes an intermediate plate member 121 and upper and lower fastening members 122 and 124 that are respectively formed at the upper and lower portions of the intermediate plate member 121. The upper fastening member 122 is formed to protrude upward from the edge of the intermediate plate member 121 and has a threaded portion formed on the outer circumferential surface thereof to connect the intermediate joint 120 to the container body 110, and is screwed with the coupling member 113 of the container body 110. The threads of the threaded portion of the upper fastening member 122 are formed with vertical grooves 122*a* at an interval of 90 degrees in the circumferential direction of the upper fastening member 122 in the same manner as the longitudinal groove 114 of the threaded portion of the coupling member 113 of the container body 110. In some embodiments of the present invention, the longitudinal grooves 114 and 122*a* are formed in the threads of the threaded portions of the container body 110 and the intermediate joint 120 as described above. Thus, when the container body 110 and the intermediate joint 120 are fastened, the air between the push plate 112 of the container body 110 and the intermediate plate member 121 is released so that the contents S are not discharged through the discharge port 111*a*.

The intermediate plate member 121 of the intermediate joint 120 is formed in a disc shape and a unidirectional check valve 126 is provided at the center of the intermediate plate member 121. By this check valve 126, air is allowed to move from the bottom to the top of the intermediate plate member 121 and prevented from movement in the opposite direction, that is, in the downward direction of the air. In addition, the concave groove 115 is formed at the lower end of the coupling member 113, and a triangular protrusion 123 corresponding to the concave groove 115 is formed in the circular plate edge of the intermediate plate member 121 so as to be coupled to the concave groove 115 formed at the lower portion of the coupling member 113 of the container body 110 when being coupled with the coupling member 113 of the container body 110. The triangular protrusions 123 are formed in the circumferential direction of the intermediate plate member 121. During the fastening of the intermediate joint 120 and the container body 110, air is released by the longitudinal grooves 114 and 122*a* of the threaded portions of the coupling member 113 of the container body 110 and the upper fastening member 122 of the intermediate joint 120 coupled to the container body 110. When the fastening of the intermediate joint 120 and the container body 110 is completed, the protrusion 123 of the intermediate plate member 121 is engaged with the concave groove 115 at the lower end of the coupling member 113 to be completely sealed.

The lower fastening member 124 of the intermediate joint 120 is coupled to the bottom support 140 and extends downward from the lower edge of the intermediate plate member 121. An annular coupling jaw 124*a* formed along the circumferential direction of the lower fastening member 124 is formed in the inner circumferential surface of the lower fastening member 124, and thus the coupling protrusion 142 of the bottom support 140 is supported by the coupling jaw 124*a*. In addition, four longitudinal guide grooves 125 spaced 90 degrees apart in the circumferential direction of the lower fastening member 124 are formed in the lower fastening member 124. Fitting protrusions 143 of the bottom support 140 are coupled with the longitudinal guide grooves 125, and are moved within the longitudinal guide grooves 125. The container body 110 and the intermediate joint 120 are moved in the vertical direction stably without being tilted.

As shown in FIG. 4, a moving groove 128*a* extending in the circumferential direction of the lower fastening member 124 from the guide groove 125 is formed below the coupling jaw 124*a* of the lower fastening member 124. The moving groove 128*a* is provided to move the fitting protrusion 143 of the bottom support 140 in the circumferential direction of the bottom support 140 instead of the vertical direction to prevent the contents from being discharged due to improper pushing of the discharge container 100 when the discharge container 100 is not used. Stopping jaws 128 are formed at one end of the moving groove 128*a* adjacent to the guide groove 125 and at the other end opposite to the guide groove 125 and a fixing groove 127 for fixing the fitting protrusion 143 is formed at the outside the opposite stopping jaw 128. Therefore, when the discharge container 100 is not used, the bottom support 140 is rotated in a clockwise direction by a predetermined force so that the fitting protrusion 143 of the bottom support 140, which is coupled to the guide groove 125, is stably engaged with the fixing groove 127 formed on the outer side of the opposite stopping jaw 128 through one of the stopping jaws 128 of the moving groove 128*a* so that the fitting protrusion 143 is impossible to vertically move by the coupling jaw 124*a* formed at the upper side of the moving groove 128*a*, thereby preventing the contents from being discharged due to malfunctions when the liquid discharge container is not in use.

In addition, the shape resilient body 130 is coupled with the lower end of the intermediate plate member 121 at the inside of the lower fastening member 124 of the intermediate plate member 121. The shape resilient body 130 has a substantially semispherical lower portion and is made of a soft material that can be compressed and recovered. A vent hole 131 is formed in the lower center of the shape resilient body 130. Thus, when the intermediate joint 120 is lowered, the shape resilient body 130 of the flexible material is brought into contact with the bottom of the bottom support 140 to close the vent hole 131 and compress the air inside the shape resilient body 130, so that the air inside the shape resilient body 130 is moved upward through the check valve 126 of the intermediate plate member 121.

The cylindrical bottom support 140 is formed of a cylindrical shape whose upper portion is opened, and includes a circular bottom plate 140*a* and a circular side wall 141 formed around the circular bottom plate 140*a* to support the liquid discharge container 100 of the present invention from the bottom. An annular coupling protrusion 142 formed on the upper end of the outer circumferential edge of the circular side wall 141 is seated and supported on the coupling jaw 124*a* of the lower coupling member 124 of the intermediate joint 120. In addition, four fitting protrusions 143 are formed on the lower side of the coupling protrusion 142 at intervals of 90 degrees along the circumferential direction of the cylindrical bottom support 140. The fitting protrusions 143 are respectively coupled with the guide grooves 125 formed on the lower fastening member 124 of the intermediate joint 120, to guide the vertical movement.

Hereinafter, a method of operating the liquid discharge container 100 according to the first embodiment of the present invention will be described with reference to the drawings.

When the container body 110 is pressed down in order to discharge the cosmetic liquid contents S contained in the container in a state where the upper cap 101 is separated from the container body 110 in the liquid discharge container 100 according to the first embodiment of the present invention, the container body 110 and the intermediate body 120 coupled to the container body 110 are lowered, and the fitting protrusion 143 of the bottom support 140 coupled to the guide groove 125 of the intermediate joint 120 is relatively raised in the guide groove 125. When the shape resilient body 130 coupled to the lower portion of the intermediate joint 120 is lowered by pressing the container body 110 as described above, the shape resilient body 130 contacts the inner bottom of the bottom support 140. That is, when the lower portion of the shape resilient body 130 contacts the inner bottom of the bottom support 140, the vent hole 131 at the lower end of the shape resilient body 130 is closed by the bottom of the bottom support 140. When the container body 110 is continuously pressed downward, the shape resilient body 130 is compressed while the vent hole 131 of the shape resilient body 130 is closed by the bottom, and the air inside the shape resilient body 130 is moved to the upper portion of the intermediate plate member 121 through the check valve 126 formed at the center of the intermediate plate member 121 of the intermediate joint 120 so that the liquid contents S are discharged via the discharge port 111*a* while the push plate 112 is lifted up (see FIG. 5).

When the pressing of the container body 110 is then released, the shape resilient body 130 is again restored and the air introduced through the gap from the outside of the bottom support 140 passes through the vent hole 131 into the shape resilient body 130. Thus, the container body 110 and the intermediate joint 120 are raised and return to the original state.

Accordingly, the present invention has the above-described structure, and thus has some advantages that the contents can be completely exhausted while easily discharging the contents S for the user's convenience, and the manufacturing cost can be reduced because of the small number of parts.

Figure 6:
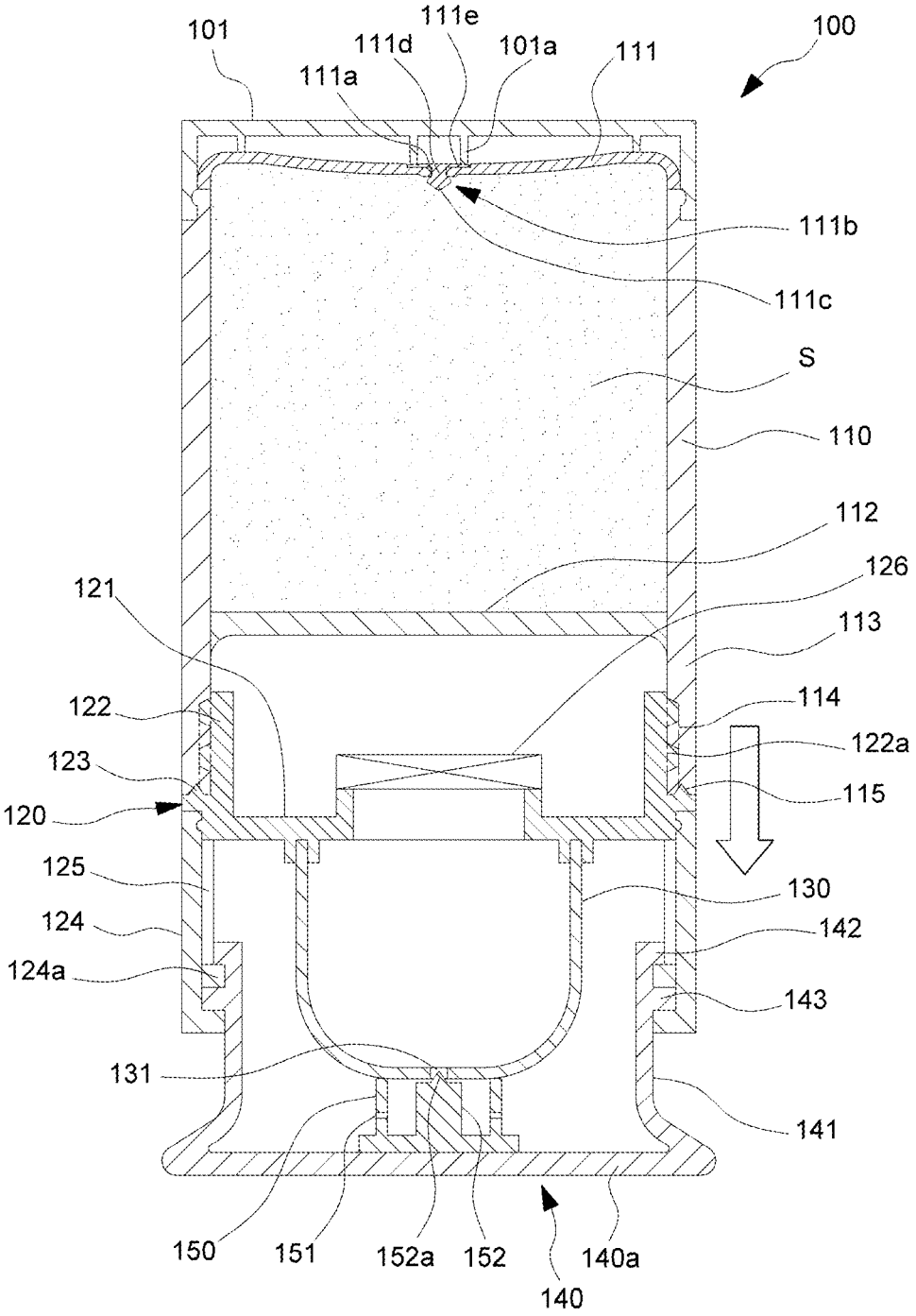
FIG. 6 is a cross-sectional view of a liquid discharge container according to a second embodiment of the present invention.
Figure 7:
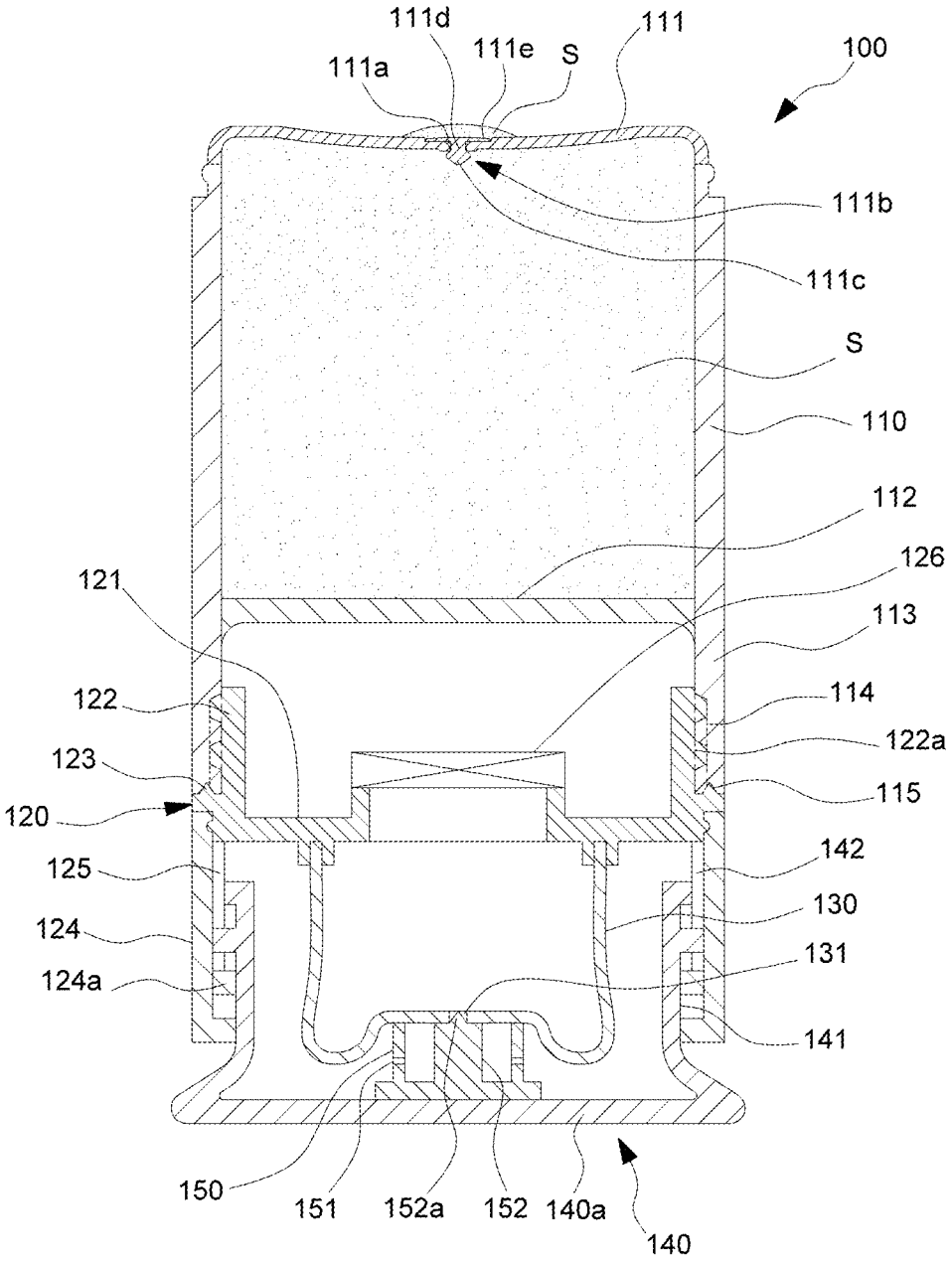
FIG. 7 is a cross-sectional view for explaining an operation of the liquid discharge container according to the second embodiment of the present invention.

Next, a liquid discharge container 100 according to a second embodiment of the present invention will be described. FIG. 6 is a cross-sectional view of the liquid discharge container 100 according to the second embodiment of the present invention, and FIG. 7 is a cross-sectional view for explaining an operation of the liquid discharge container 100 according to the second embodiment of the present invention.

The liquid discharge container 100 according to the second embodiment is different from the first embodiment in that a circular support wall 150 for supporting the lower portion of the shape resilient body 130 is provided at the bottom of the bottom support 140, and a central protrusion 152 is formed at the inner center of the circular support wall 150, in the second embodiment.

The circular support wall 150 is formed in a cylindrical shape at the bottom of the inside of the bottom support 140 to support the lower portion of the shape resilient body 130 to stably support the shape resilient body 130 and to operate the container more accurately. In addition, a plurality of flow holes 151 through which air flows are formed on the outer circumferential surface of the circular support wall 150.

The central protrusion 152 formed at the center of the inside of the circular support wall 150 is formed to protrude from the bottom support 140 for closing the vent hole 131 of the shape resilient body 130 and a conical closing protrusion 152*a* is formed at the center of the upper portion of the circular support wall 150 to more stably close the circular vent hole 131 of the shape resilient body 130 when the shape resilient body 30 is lowered.

Therefore, in the second embodiment of the present invention, when the container body 110 is pressed while the shape resilient body 130 is being supported by the circular support wall body 150, the intermediate joint 120 is lowered together with the container body 110. Accordingly, the shape resilient body 130 coupled to the intermediate joint 120 descends and the conical closing protrusion 152*a* of the central protrusion 152 is inserted into the vent hole 131 of the shape resilient body 130. The shape resilient body 130 is compressed while the vent hole 131 is closed. Accordingly, the air inside the shape resilient body 130 is supplied upward through the check valve 126 of the intermediate joint 120 so that the contents S are discharged whole the push plate 12 is lifted up.

Other configurations and effects are the same as those of the first embodiment, and a detailed description thereof will be omitted.

Figure 8:
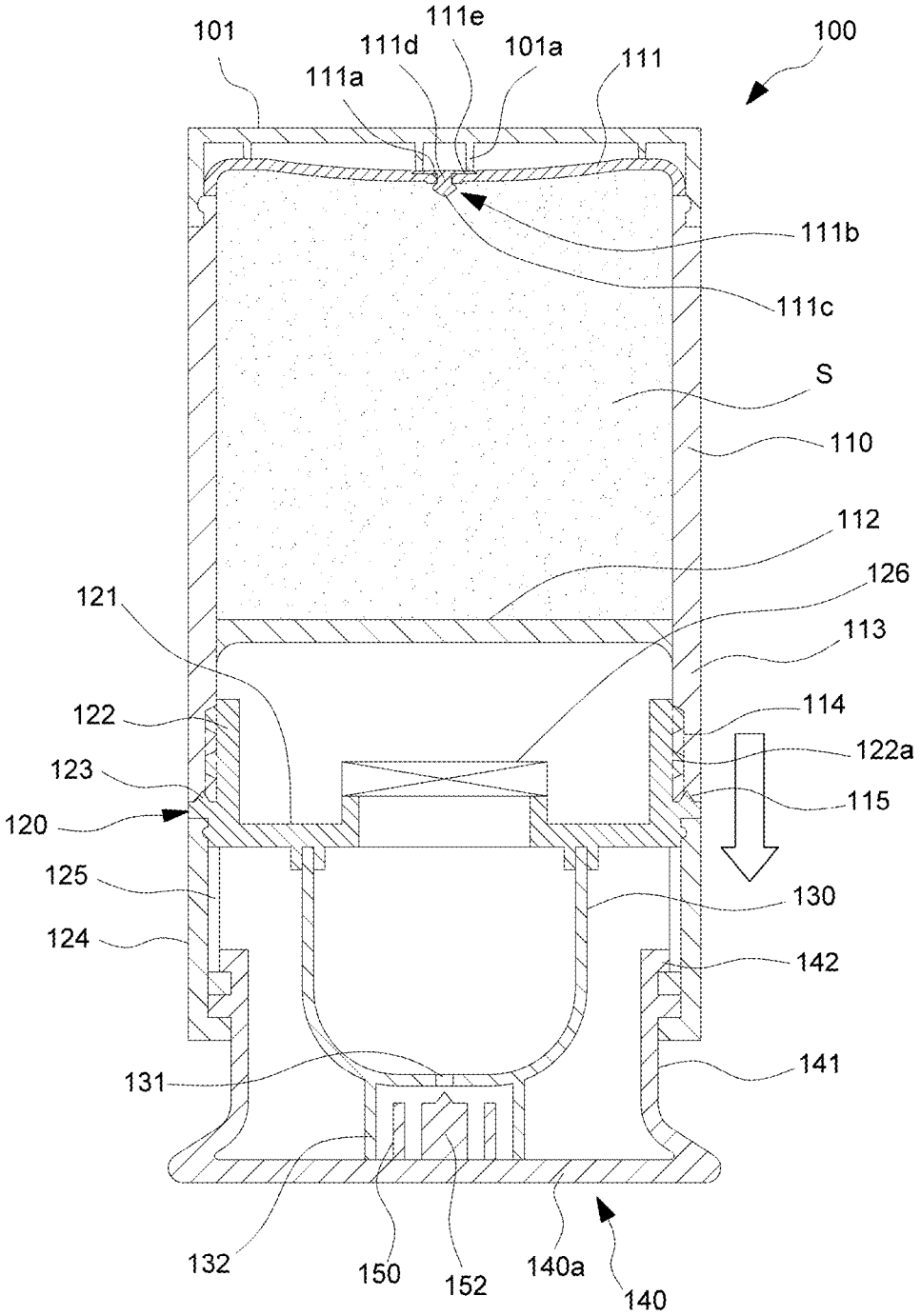
FIG. 8 is a cross-sectional view of a liquid discharge container according to a third embodiment of the present invention.
Figure 9:
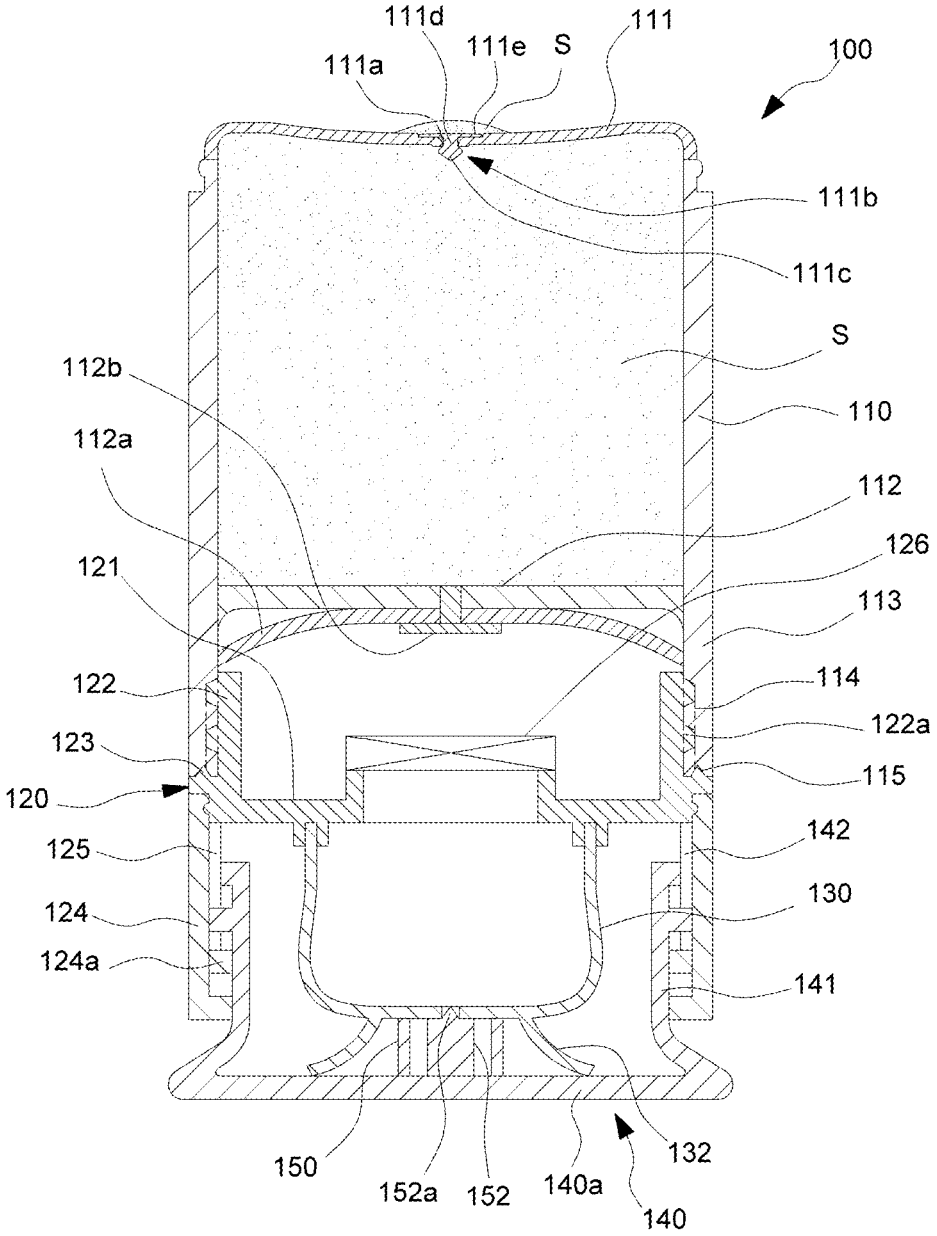
FIG. 9 is a cross-sectional view for explaining an operation of the liquid discharge container according to the third embodiment of the present invention.

Next, a liquid discharge container 100 according to a third embodiment of the present invention will be described. FIG. 8 is a cross-sectional view of the liquid discharge container 100 according to the third embodiment of the present invention, and FIG. 9 is a cross-sectional view for explaining an operation of the liquid discharge container 100 according to the third embodiment of the present invention.

The liquid discharge container 100 according to the third embodiment is different from the second embodiment in that a plurality of support legs 132 for supporting the shape resilient body 130 are formed under the shape resilient body 130 in the third embodiment. The plurality of support legs 132 formed at the lower portion of the shape resilient body 130 are formed integrally with the shape resilient body 130 with a soft material and are spaced apart from each other at a predetermined interval below the shape resilient body 130. In this embodiment, three legs 132 are formed.

Therefore, in the third embodiment of the present invention, the lower ends of the three support legs 132 are brought into contact with the bottom of the bottom support 140. When the intermediate joint 120 is lowered together with the container body 110 by pressing the container body 110 in a state where the shape resilient body 130 is supported, the shape resilient body 130 coupled to the intermediate joint 120 is lowered as shown in FIG. 9, so that the conical closing protrusion 152*a* of the central protrusion 152 is inserted into the vent hole 131 of the shape resilient body 130 while the support legs 132 are bent outward, to close the vent hole 131. In addition, the lower portion of the shape resilient body 130 is further closed while the upper end of the circular support wall 150 contacts the lower portion of the shape resilient body 130. The closed shape resilient body 130 is compressed so that the air inside the shape resilient body 130 is supplied to the upper side through the check valve 126 of the intermediate joint 120 so that the contents S are discharged as the push plate 112 rises up. Then, when the pressing of the container body 110 is released, the shape resilient body 130 and the support legs 132 are restored to their original states and the resilience of the support legs 132 assists the resilience of the shape resilient body 130 and the container body 110.

In the third embodiment, the support legs 132 supporting the shape resilient body 130 are bent so that there are some advantages that the vent hole 131 is primarily closed by the closing protrusion 152*a* of the central protrusion 152, and the lower portion of the shape resilient body 130 is closed by the circular support wall 150 so that the operation of the container is more stably performed.

Other configurations and effects are the same as those of the previous embodiments, and a detailed description thereof will be omitted.

Figure 10:
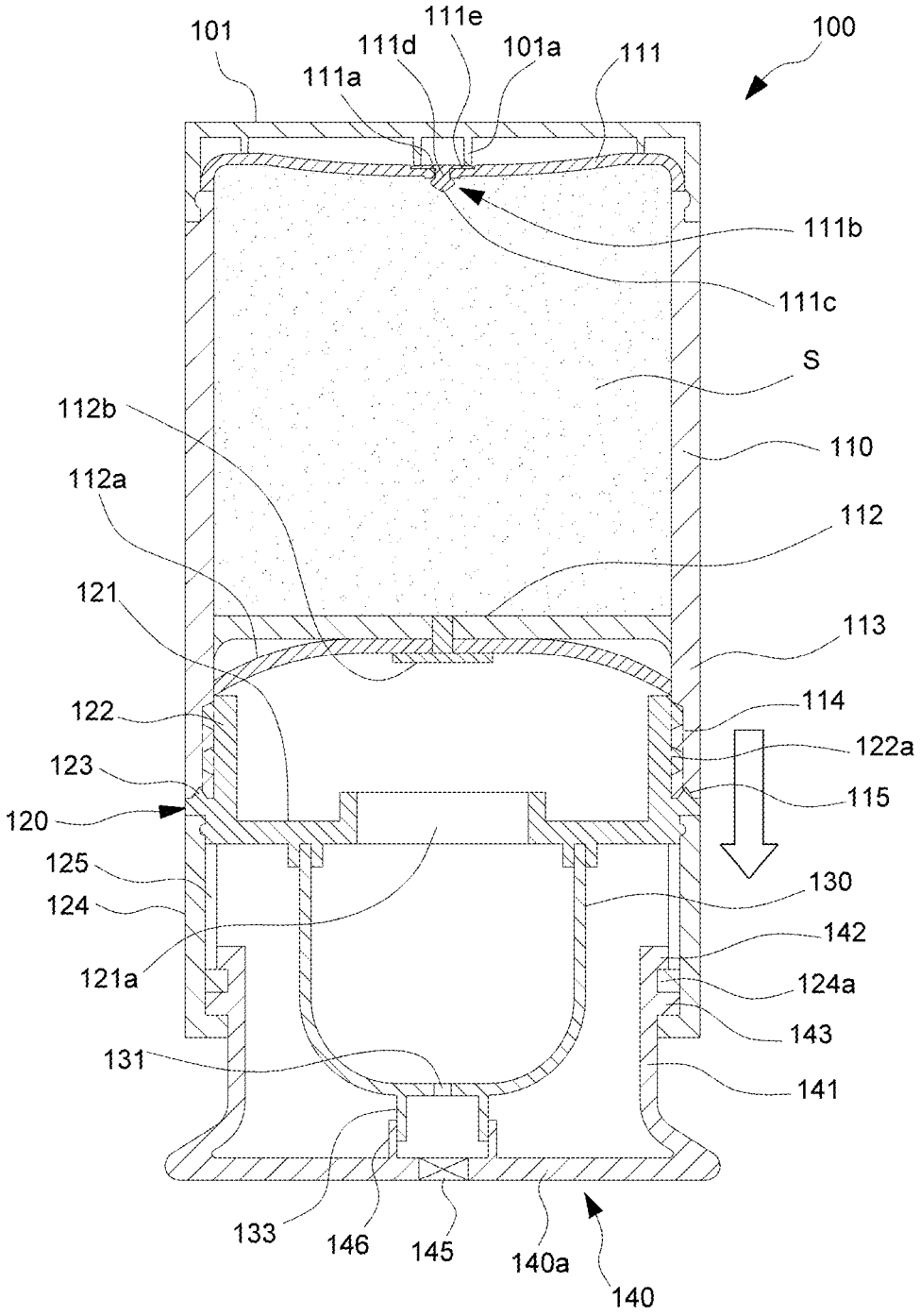
FIG. 10 is a cross-sectional view of a liquid discharge container according to a fourth embodiment of the present invention.

Next, a liquid discharge container 100 according to a fourth embodiment of the present invention will be described. FIG. 10 is a cross-sectional view of a liquid discharge container 100 according to a fourth embodiment of the present invention.

The liquid discharge vessel 100 according to the fourth embodiment differs from the first embodiment in that a throughhole 121*a* is formed at the center of the intermediate plate member 121 without a check valve 126, and circular support legs 133 are integrally formed at a lower portion of the shape resilient body 130 and circular coupling protrusions 146 are formed in the cylindrical bottom support 140 so that the circular support legs 133 are coupled to the inside of the circular coupling protrusions 146, in the fourth embodiment. The inner bottom of the circular coupling protrusion 146 in the cylindrical bottom support 140 is provided with a check valve 145 that allows the inflow of air from the outside into the cylindrical bottom support 140 and prevents the air from flowing out in the opposite direction.

Therefore, in the fourth embodiment of the present invention, when the intermediate joint 120 is lowered together with the container body 110 by pressing the container body 110, in a state where the circular support legs 133 of the shape resilient body 130 are coupled to the inside of the circular coupling protrusions 146 of the cylindrical bottom support 140, the shape resilient body 130 is lowered and the shape resilient body 130 is compressed so that the air inside the shape resilient body 130 flows through the throughhole 121*a* of the intermediate joint 120 so that the contents S are discharged while the push plate 112 is lifted up. In addition, when the depression of the container body 110 is released, the shape resilient body 130 and the container body 110 are restored to the original states and air is introduced into the cylindrical bottom support 140 through the check valve 145 of the cylindrical bottom support 140 and the introduced air flows into the inside of the shape resilient body 130 through the vent hole 131 of the inside of the circular support legs 133.

Next, a liquid discharge container 100 according to a fifth embodiment of the present invention will be described. FIG. 11 is a cross-sectional view of a liquid discharge container 100 according to a fifth embodiment of the present invention.

The liquid discharge container 100 according to the fifth embodiment differs from the liquid discharge device 100 according to the fourth embodiment in that the fourth embodiment has been configured so that the discharge port insertion member 111*b* in the upper plate 111 of the container body 110 has been inserted into the discharge port 111*a* in the same manner as those previous embodiments, but the discharge port insertion member 111*b* is not coupled to the discharge port 111*a* and a check valve 111*g* is provided under the discharge port 111*a* in the case of the fifth embodiment as shown in FIG. 11.

In the fifth embodiment, the check valve 111*g* is provided spaced by a predetermined distance below the discharge port 111*a* of the upper plate 111. A cylindrical mounting portion 111*f* is formed on a lower surface of the upper plate 111 and a check valve 111*g* is coupled to the center of the bottom of the cylindrical mounting portion 111*f* by being spaced apart from the discharge port 111*a*.

In the fifth embodiment, the check valve 111*g* provided below the discharge port 111*a* allows the contents of the container body to be discharged via the discharge port 111*a* through the check valve so that the contents S are allowed to move up through the check valve 111*g* and to prevent the contents S from moving downward in the opposite direction.

Accordingly, when the contents are to be discharged by pressing the container body 110, the contents S accommodated in the container body 110 are first filled in the cylindrical mounting portion 111*f* through the check valve 111*g*, and are discharged via the discharge port 111*a*. When the depression of the container body 110 is released, the contents S are prevented from falling down below the discharge port 111*a* by the check valve 111*g*. In addition, the contents S do not go down, thereby further preventing the push plate 112 from moving downward.

The upper plate 111 shown in FIG. 11 having the above-described configuration can be applied to the previous embodiments as well.

According to some embodiments of the present invention, there is provided a liquid discharge container having a dispenser structure for discharging a liquid material easily, to thereby completely exhaust the contents while providing easy operations, and reduce manufacturing cost with fewer parts.

While the present invention has been particularly shown and described with reference to exemplary embodiments thereof, it is to be understood that the invention is not limited to the disclosed embodiments, but it will be readily understood that many variations and modifications may be made without departing from the spirit and scope of the invention as defined by the appended claims.

What is claimed is:

1. A liquid discharge container, comprising:

a container body having a space in which liquid contents are accommodated, a discharge port, through which the contents are discharged, formed at the center of an upper plate, and a push plate, coupled to an interior of the container body, for supporting the contents and pushing up the contents and discharging the contents through the discharge port;

an intermediate joint having an intermediate plate member coupled to a lower side of the container body and having a throughhole at a center of the intermediate plate member and a lower fastening member formed at a lower portion of the intermediate plate member;

a shape resilient body that is coupled to a lower portion of the intermediate joint, and is formed to be compressible and recoverable with a vent hole at the lower center of the shape resilient body, and a circular support leg around the vent hole, thereby compressing air in the shape resilient body by the descent of the intermediate joint, to thus make the air in the shape resilient body move upward; and a cylindrical bottom support comprising a circular bottom plate and a circular side wall formed around the circular bottom plate and coupled to the lower fastening member of the intermediate joint so as to be elevated and lowered, in which a circular coupling protrusion is formed on the circular bottom plate of the cylindrical bottom support so that the circular support leg is coupled to the inner side of the circular coupling protrusion and a check valve is formed on the inner bottom of the circular coupling protrusion to allow the inflow of air into the container body and prevent the air to flow out from the container body, wherein the lower fastening member of the intermediate joint is coupled and vertically moveable to the circular side wall of the cylindrical bottom support, wherein, when the contents are to be discharged, the container body is pressed down to lower the intermediate joint together with the container body, and the shape resilient body coupled to the intermediate joint is lowered, so that the shape resilient body is compressed and the internal air of the shape resilient body is supplied to a lower portion of the container body through the throughhole of the intermediate joint and the contents are discharged while the push plate is lifted up.

2. The liquid discharge container of claim 1, wherein a discharge port insertion member is coupled to the discharge port of the upper plate and the discharge port insertion member includes: an intermediate insertion portion having a smaller diameter than the discharge port and inserted into the discharge port;

a seating portion formed on an upper portion of the intermediate insertion portion and seated on the upper plate; and a wedge-shaped wedge portion formed at a lower portion of the intermediate insertion portion so that the discharge port insertion member is not drawn upward from the discharge port.

3. The liquid discharge container of claim 2, wherein an upper cap is provided in the upper portion of the container body so as to be opened and closed with respect to the container body, and a circular pressing leg portion for pressing the seating portion of the discharge port insertion member and closing the discharge port is formed to extend downwardly from the upper cap.

4. The liquid discharge container of claim 1, wherein a support foot portion is coupled to the lower portion of the push plate to prevent the push plate from moving below the container body, the center of the support foot portion is coupled to the push plate by an engaging member, and the support foot portion is divided into a plurality of support feet extending radially from the center of the support foot portion and end portions of the plurality of support feet are in contact with an inner circumferential surface of the container body.

5. The liquid discharge container of claim 1, wherein a cylindrical mounting portion is formed on the lower surface of the upper plate and a check valve located below the discharge port is coupled to the center of the bottom of the cylindrical mounting portion, to allow the contents to move upward and to prevent the contents from moving downward, so that the contents of the container body is discharged to the discharge port through the check valve.

* * * * *